US005851973A

United States Patent [19]

Foley

[11] Patent Number: 5,851,973

[45] Date of Patent: Dec. 22, 1998

[54] MANUAL DISHWASHING COMPOSITION COMPRISING AMYLASE AND LIPASE ENZYMES

[75] Inventor: Peter Robert Foley, Newcastle upon Tyne, United Kingdom

[73] Assignee: The Procter & Gamble Company, Cincinnati, Ohio

[21] Appl. No.: 605,124

[22] PCT Filed: Sep. 1, 1994

[86] PCT No.: PCT/US94/09966

§ 371 Date: Jun. 28, 1996

§ 102(e) Date: Jun. 28, 1996

[87] PCT Pub. No.: WO95/07980

PCT Pub. Date: Mar. 23, 1995

[30] Foreign Application Priority Data

Sep. 14, 1993 [EP] European Pat. Off. ..... 93307240.7

[51] Int. Cl.[6] ..... C11D 3/386; C11D 3/37; C11D 3/20

[52] U.S. Cl. ..... 510/235; 510/236; 510/237; 510/392; 510/393; 510/320; 510/321; 510/530

[58] Field of Search ..... 510/235, 236, 510/237, 392, 393, 530, 320, 321

[56] References Cited

U.S. PATENT DOCUMENTS

| | | | |
|---|---|---|---|
| 4,566,985 | 1/1986 | Bruno et al. | 134/42 |
| 4,908,150 | 3/1990 | Hessel et al. | 510/393 |
| 5,200,115 | 4/1993 | Giesen et al. | 252/557 |
| 5,230,823 | 7/1993 | Wise et al. | 510/235 |
| 5,269,974 | 12/1993 | Ofosu-Asante | 510/237 |
| 5,318,715 | 6/1994 | Keishnan | 252/99 |
| 5,376,310 | 12/1994 | Cripe et al. | 510/235 |
| 5,378,409 | 1/1995 | Ofosu-Asante | 510/235 |
| 5,415,801 | 5/1995 | Ofosu-Asante | 252/174.17 |
| 5,415,814 | 5/1995 | Ofosu-Asante | 510/235 |
| 5,417,893 | 5/1995 | Ofosu-Asante | 510/235 |
| 5,470,509 | 11/1995 | Pancleri | 510/320 |
| 5,472,628 | 12/1995 | Panandiker et al. | 510/300 |
| 5,527,484 | 6/1996 | Ahmed et al. | 510/226 |

*Primary Examiner*—Kery A. Fries
*Attorney, Agent, or Firm*—Jacobus C. Rasser; Ken K. Patel; Kim W. Zerby

[57] ABSTRACT

This invention is a manual dishwashing composition which comprises surfactant, calcium or magnesium ions, amylase enzymes, lipase enzymes, and polycarboyxlic polymer thickeners. An additional agent includes a calcium stabilizing agent such as malic acid or malic acid salt, maleic acid or maleic acid salt.

16 Claims, No Drawings

MANUAL DISHWASHING COMPOSITION COMPRISING AMYLASE AND LIPASE ENZYMES

The formulator of a manual dishwashing detergent composition faces the challenge of deriving a formulation which meets a number of distinct consumer relevant performance demands.

Firstly, such a composition should be effective at removing soils from dirty "dishes" when used in a manual dishwashing process. The term "dishes" is used herein in a generic sense, and encompases essentially any items which may be found in a dishwashing load, including chinaware, glassware, plasticware, hollowware and cutlery, including silverware.

The soils encountered in dishwashing will largely but not exclusively be food based. Particularly difficult soils to remove would include greasy soils, burnt or baked on food soils, dried on food soils, highly coloured soils derived from eg: highly coloured vegetables such as beetroot and tomato, as well as non-food soils such as lipstick on the rims of glasses or nicotine stains on saucers which have been used as ashtrays.

Once the soils has been removed from the dishes the dishwashing detergent should act such as to suspend these soils in the wash solution and thus prevent their redeposition onto the dishes, or onto the surface of the sink.

Whilst good soil removal and antiredeposition are performance demands shared with compositions formulated for machine dishwashing purposes, the manual dishwashing formulator is faced with meeting other performance demands.

For example, the manual dishwashing composition should be high sudsing and the sudsing should persist throughout the washing process. The sudsing is used as an indicator by the person doing the washing up that the wash solution still contains active detergent ingredients. When the sudsing subsides the sink will generally be emptied and a fresh wash solution prepared. The persistence of suds throughout the washing process is measured in the industry by various suds mileage indices.

The manual dishwashing composition should also be mild to the skin, and particularly to the hands. That is, it should not cause skin dryness, chapping or rougness when in contact with the skin. Such skin dryness, chapping or roughness largely results from the removal of natural oils, specifically epidermal lipids, from the skin. Thus, the manual dishwashing composition should desirably be effective at removing grease from plates but not epidermal lipids from the skin.

Reflecting the different nature of the performance demands for a manual dishwashing composition, such compositions are formulated in a distinct way from, for example, machine dishwashing, laundry, and hard surface cleaner compositions.

Manual dishwashing compositions are usually unbuilt, and may contain added levels of Ca and Mg to aid cleaning performance. Laundry and automatic dishwashing compositions typically contain high levels of builder.

Manual dishwashing compositions typically contain no bleaching components, which are by contrast common components of laundry, machine dishwashing and hard-surface cleaner compositions.

Manual dishwashing detergent typically contain high levels of high-sudsing surfactant and often suds booster. Machine laundry and dishwashing compositions are desirably low foaming and typically contain lower levels of surfactant.

Manual dishwashing compositions are formulated to perform well at near neutral pH. Machine dishwashing and laundry compositions are typically alkaline with a pH of usually 9–11. Bleach-containing hard-surface cleaner compositions are often acidic with a pH of less than 6.

The key active component of a manual dishwashing composition is most usually a surfactant system, which will typically comprise from 5 to 80% by weight of the composition. The surfactant system has a primary soil removal purpose, and also acts so as to suspend the soils in solution and prevent redeposition of these soils. In particular, the surfactant system should be effective at removing and suspending greasy soils.

Amylolytic, proteolytic and lipolytic enzymes are common components of laundry and machine dishwashing compositions, formulated in either granular or fluid (liquid/gel) form. Enzymes are not commonly recognized to be of use in manual dishwashing compositions.

Amylolytic enzymes, or amylases, act to catalyse the hydrolysis of starch. Proteolytic enzymes, or proteases, act to catalyse the hydrolysis of peptide bonds in proteins. Lipolytic enzymes, or lipases, act to catalyse the hydrolysis of fats or oils, which comprise esters of glycerol and fatty acids, into these glycerol and fatty acid components.

The Applicants have now recognized the value of the inclusion of lipolytic enzyme in combination with amylolytic enzyme in compositions specifically formulated for use in manual dishwashing. The specific utility of the combination of lipolytic enzyme with amylolytic enzyme in such compositons has not previously been recognized in the art. Indeed, the extensive art relating to the use of such enzymes, in combination, in machine dishwashing and laundry compositions, but neglecting to provide clear teaching of their utility in manual dishwashing, would seem to imply a prejudice against the use of these enzymes in manual dishwashing compositions.

At the heart of this implied prejudice may lie the well-established reliance in the manual dishwashing art on surfactants to aid grease removal. With high concentrations of surfactant to remove the grease, it might be believed that the inclusion of lipolytic enzyme, which acts such as to hydrolyse grease, would not be useful. A further reason for the implied prejudice might rest in the belief that the fatty acid products obtained when oils or fats are broken down by lipolytic enzyme may act as suds suppressors, thereby impending the desired high sudsing performance.

The Applicants have found that the combination of lipolytic and amylolytic enzyme is especially useful in aiding removal of baked on, or burnt on soils from articles in the wash. Such soils are known to be particularly difficult to remove in a manual dishwashing process, being solid in nature and typically strongly adhered to the soiled substrate.

Removal of such baked or burnt on soils is particularly enhanced when the lipolytic and amylolytic enzyme containing compositions are employed in a wash process including a soaking step. The soaking step can involve immersing the soiled articles in a dilute solution containing the detergent composition for a period of time. Alternatively, a highly concentrated solution of the composition can be applied directly to the surface of the dishes, being allowed to remain there for a period of time, prior to subsequent rinsing/washing steps.

The Applicants have also found that the combination of lipolytic and amylolytic enzyme is particularly useful in a fluid, particularly liquid, manual dishwashing composition containing certain surfactant systems which act such as to stabilize the enzymes.

SUMMARY OF THE INVENTION

According to one aspect of the present invention there is provided a composition containing a surfactant system, lipolytic enzyme and amylolytic enzyme suitable for use in a manual dishwashing method.

Preferably said composition is in the form of a liquid or a gel.

Preferably said composition contains no builder salts.

Preferably said composition contains no bleaching components.

Preferably said composition contains from 5% to 80% by weight of said surfactant system, wherein the surfactant system comprises surfactant selected from nonionic, anionic, cationic, zwitterionic, ampholytic and amphoteric surfactants.

In one aspect of the invention, preferably said composition is high sudsing.

DETAILED DESCRIPTION OF THE INVENTION

Lipolytic Enzyme

The first essential component of the compositions in accordance with the invention is lipolytic enzyme (lipase) which is preferably present at levels of active lipolytic enzyme of from 0.001% to 2% by weight, more preferably 0.005% to 1% by weight, most preferably from 0.01% to 0.5% by weight of the compositions.

The lipase is preferably bacterial in origin being obtained, for example, from a lipase producing strain of Humicola sp. or Thermomyces sp. or *Pseudomonas pseudoalcaligenes* or *Pseudomas fluorescens.*

Lipase from chemically or genetically modified mutants of these strains are also included herein. Mixtures of lipase from various strains are included herein, though not preferred.

A preferred lipase is derived from *Pseudomonas pseudoalcaligenes,* which is described in Granted European Patent, EP-B-0218272.

Another preferred lipase herein is obtained by cloning the gene from *Humicola lanuginosa* and expressing the gene in *Aspergillus oryza,* as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Lipases herein are preferably compatible with surfactants. They are preferably stable in the present compositions and improve cleaning when they are included in the present compositions.

Suitable lipases include those which show a positive immunological cross-reaction with the antibody of the lipase produced by Pseudomonas flluorescens. This lipases described in Japanese Patent Application 53-20487, laid open Feb. 24, 1987. It is available under the trade name Lipase P Amano. A method for testing immunological cross-reaction with Amano P antibody is described in U.S. Pat. No. 4,707,291, Thom et al, issued Nov. 17, 1987.

A lipase unit (LU) is defined as the amound of lipase which produces 1 umol of titratable butyric acid per minute in a pH stat, where pH is 7.0, temperature is 30° C., and substrate is an emulsion of ributyrin and gum arabic in the presence of Ca++ and NaCl in phosphate buffer.

Amylolytic Enzyme

The second essential component of the compositions in accordance with the invention is amylolytic enzyme (amylase) incorporated at a preferred level of from 0.005% to 2% active enzyme by weight of the composition.

Preferred amylases include, for example, alpha-amylases obtained from a special strain of B licheniforms, described in more detail in GB 1,269,839 (Novo). Preferred commercially available amylases include for example, Rapidase, sold by International Bio-Synthetics Inc, and Termamyl, sold by Novo Industries A/S.

The amylolytic enzyme is preferably incorporated at a level such that the weight ratio of active lipolytic enzyme to active amylolytic enzyme is from 20:1 to 1:20, preferably from 10:1 to 1:10, more preferably from 5:1 to 1:5.

Proteolytic Enzyme

Proteolytic (protease) enzyme may be incorporated into the compositions in accordance with the invention at a preferred level of from 0.005% to 2% active enzyme by weight of the composition.

Preferred commercially available protease enzymes include those sold under the tradenames Alcalase and Savinase by Novo Industries A/S (Denmark) and Maxatase by International Bio-Synthetics, Inc. (The Netherlands).

Enzyme Stabilizing System

Preferred enzyme-containing compositions herein may comprise from 0.001% to 10%, preferably from 0.005% to 8%, most preferably from 0.01% to 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

The compositions herein may further comprise from 0 to 10%, preferably from 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from 0.5 ppm to 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in solid-form composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Composition pH

Detergent compositions in accord with the invention will preferably be formulated such that during use in aqueous cleaning operations, particulary those where a dilute solution of the detergent composition is employed, the wash solution will have a pH of between about 5.0 and about 8.0. Compositions for use in such aqueous cleaning operations themselves preferably have a pH as a 1% solution in water at 20° C. of between about 5.5 and about 8.5, most preferably between about 6.8 and about 7.8.

In another aspect of the invention compositions may be formulated for use in dishwashing methods in which the detergent composition is applied to the dishes in essentially concentrated form, and preferably allowed to remain on the dishes for an extended period of time. Compositions for use in such methods may be formulated to have a pH, as a 1% solution in water, of from 3 to 6, preferably from 3.5 to 4.5.

Techniques for controlling pH at recommended usage levels include the use of buffers, alkali, acids, etc., and are well known to those skilled in the art. Dilute hydrochloric acid is preferred for downward pH adjustment, and sodium hydroxide for upward pH adjustment.

Surfactant System

The compositions of the invention contain a surfactant system at a level of from 5% to 80%, preferably from 10% to 60%, most preferably from 15% to 50% by weight of the composition.

The surfactant system is preferably formulated to be compatible with the enzyme components. In liquid or gel compositions the surfactant system is most preferably formulated such that it promotes, or at least does not degrade, the stability of the enzymes in these compositions.

The surfactant system comprises surfactant selected from nonionic, anionic, cationic, zwitterionic, ampholytic and amphoteric surfactants, and any mixtures thereof.

Preferably the surfactant system comprises from 5% to 95% by weight, more preferably from 30% to 70% by weight of the surfactant system of anionic surfactant, and from 5% to 95% by weight, more preferably from 30% to 70% by weight of the surfactant system of nonionic surfactant.

In preferred compositions in accord with the invention, formulated to have enhanced mildness to the skin, the weight ratio of nonionic surfactant to anionic surfactant is preferably greater than 1:1.

Anionic Surfactant

The anionic surfactant may be essentially any anionic surfactant, including anionic sulfate, sulfonate or carboxylate surfactant.

Anionic Sulfate Surfactant

The anionic sulfate surfactant may be any organic sulfate surfactant. It is preferably selected from the group consisting of $C_{10}$–$C_{16}$ alkyl sulfate which has been ethoxylated with an average of from 0.5 to 20 moles of ethylene oxide per molecule, $C_9$–$C_{17}$ acyl-N-(C1–C4 alkyl) glucamine sulfate and mixtures thereof.

Alkyl ethoxy sulfate surfactants suitable for use herein comprise a primary alkyl ethoxy sulfate derived from the condensation product of a $C_{10}$–$C_{16}$ alcohol with an average of from 0.5 to 20, preferably from 0.5 to 12, ethylene oxide groups. $C_{12}$–$C_{14}$ alkyl sulfate which has been ethoxylated with an average of from 0.5 to 4 moles of ethylene oxide per molecule is especially preferred.

The counterion for the anionic sulfate surfactant component is preferably selected from calcium, sodium, potassium, magnesium, ammonium, or alkanol-ammonium, and mixtures thereof, with calcium and magnesium being preferred for cleaning and sudsing, respectively.

Anionic Sulfonate Surfactant

Anionic sulfonate surfactants suitable for use herein include, for example, the salts (e.g. alkali metal salts) of $C_9$–$C_{20}$ linear alkylbenzene sulfonates, $C_8$–$C_{22}$ primary or secondary alkane sulfonates, $C_8$–$C_{24}$ olefin sulfonates, sulfonated polycarboxylic acids, alkyl glycerol sulfonates, fatty acyl glycerol sulfonates, fatty oleyl glycerol sulfonates, paraffin sulfonates, and any mixtures thereof.

Anionic Alkyl Ethoxy Carboxylate Surfactant

Alkyl ethoxy carboxylates suitable for use herein include those with the formula $RO(CH_2CH_2O)x\ CH_2COO—M^+$ wherein R is a $C_{12}$ to $C_{16}$ alkyl group, x ranges from 0 to 10, and the ethoxylate distribution is such that, on a weight basis, the amount of material where x is 0 is less than 20%, preferably less than 15%, most preferably less than 10%, and the amount of material where x is greater than 7, is less than 25%, preferably less than 15%, most preferably less than 10%, the average x is from 2 to 4 when the average R is $C_{13}$ or less, and the average x is from 3 to 6 when the average R is greater than $C_{13}$, and M is a cation, preferably chosen from alkali metal, alkaline earth metal, ammonium mono-, di-, and tri-ethanol-ammonium, most preferably from sodium, potassium, ammonium and mixtures thereof with magnesium ions. The preferred alkyl ethoxy carboxylates are those where R is a $C_{12}$ to $C_{14}$ alkyl group.

Anionic Alkyl Polyethoxy Polycarboxylate Surfactant

Alkyl polyethoxy polcarboxylate surfactants suitable for use herein include those having the formula:

$$R—O—(\underset{\underset{R_1}{|}}{CH}—\underset{\underset{R_2}{|}}{CH}—O)_x—R_3$$

wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Anionic Secondary Soap Surfactant

Secondary soap surfactants (aka "alkyl carboxyl surfactants") useful herein are those which contain a carboxyl unit connected to a secondary carbon. It is to be understood herein that the secondary carbon can be in a ring structure, e.g. as in p-octyl benzoic acid, or as in alkyl-substituted cyclohexyl carboxylates. The secondary soap surfactants should contain no ether linkages, no ester linkages and no hydroxyl groups. There should be no nitrogen atoms in the head-group (amphiphilic portion). The secondary soap surfactants usually contain 11–13 total carbon atoms, although slightly more (e.g., up to 16) can be tolerated.

The following general structures further illustrate some of the secondary soap surfactants (or their precursor acids) useful herein.

A. A highly preferred class of secondary soaps useful herein comprises the secondary carboxyl materials of the formula $R^3$ $CH(R^4)COOM$, wherein $R^3$ is $CH_3(CH_2)x$ and $R^4$ is $CH_3(CH_2)y$, wherein y can be 0 or an integer from 1 to 4, x is an integer from 4 to 10 and the sum of (x+y) is 6–10, preferably 7–9, most preferably 8.

B. Another class of secondary soaps useful herein comprises those carboxyl compounds wherein the carboxyl substituent is on a ring hydrocarbyl unit, i.e., secondary soaps of the formula $R^5$-$R^6$-COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another class of secondary soaps comprises secondary carboxyl compounds of the formula $CH_3(CHR)_k$—$(CH_2)_m$—$(CHR)_n$—$CH(COOM)(CHR)_o$—$(CH2)_p$—$(CHR)_q$—$CH_3$, wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion, e.g., H, alkali metal, alkaline earth metal, ammonium, alkanolammonium, di- and tri-alkanolammonium, and $C_1$–$C_5$ alkyl substituted ammonium. Sodium is convenient, as is diethanolammonium.

Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Other Anionic Surfactants

Other anionic surfactants useful for detersive purposes can also be included in the compositions hereof. These can include salts (including, for example, sodium, potassium, ammonium, and substituted ammonium salts such as mono-, di- and triethanolamine salts) of soap, fatty oleyl glycerol sulfates, alkyl phenol ethylene oxide ether sulfates, alkyl phosphates, isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described herein), branched primary alkyl sulfates, alkyl polyethoxy carboxylates such as those of the formula $RO(CH_2CH_2O)_kC_2COO\text{-}M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Nonionic Surfactant

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants are listed below.

Nonionic Polyhydroxy Fatty Acid Amide Surfactant

Polyhydroxy fatty acid amides suitable for use herein are those having the structural formula:

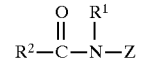

(I)

wherein: $R^1$ is H, $C_1$–$C_4$ hydrocarbyl, 2-hydroxy ethyl, 2-hydroxy propyl, or a mixture thereof, preferable $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight-chain $C_7$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH2—OH_2$, $—CH(CH_2OH)—(CHOH)_n—$, $—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylate derivative thereof. Most preferred are glycityls wherein n is 4, particularly $—CH_2—(CHOH)_4—CH_2OH$.

In Formula (I), R1 can be, for example, N-methyl, N-ethyl, N-propyl, N-isopropyl, N-butyl, N-2-hydroxy ethyl, or N-2-hydroxy propyl.

R2-CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula:

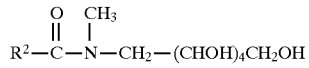

wherein $R^2$ is a straight chain $C_{11}$–$C_{17}$ alkyl or alkenyl group.

Nonionic Condensates of Alkyl Phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 12 carbon atoms in either a straight chain or branched chain configuration with the alkylene oxide.

Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from about 2 to about 10 moles of ethylene oxide per mole of alcohol. Most preferred are the condensation products of alcohols having an alkyl group containing from 10 to 14 carbon atoms with from about 6 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.54 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and Kyro™ EOBN (the condensation product of $C_{13}$–$C_{15}$ alcohol with 9 moles ethylene oxide), marketed by The Procter & Gamble Company.

Nonionic EO/PO Condensates with Propylene Glycol

The condensation products of ethylene oxide with a hydrophobic base formed by the condensation of propylene oxide with propylene glycol are suitable for use herein. Examples of compounds of this type include certain of the commercially-available Pluronic™ surfactants, marketed by BASF.

Nonionic EO Condensation Products with Propylene Oxide/Ethylene Diamine Adducts

The condensation products of ethylene oxide with the product resulting from the reaction of propylene oxide and ethylenediamine are suitable for use herein. Examples of this type of nonionic surfactant include certain of the commercially available Tetronic™ compounds, marketed by BASF.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containng from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galatoses. Suitable mixtures include coconut alkyl, di-, tri-, tetra-, and pentaglucosides and tallow alkyl tetra-, penta- and hexaglucosides.

The preferred alkylpolyglycosides have the formula:

$$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-,3-, 4- and/or 6-position, preferably predominantly the 2-position.

Nonionic Fatty Acid Amide Surfactant

Fatty acid amide surfactants suitable for use herein are those having the formula:

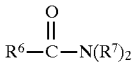

wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and $—(C_2H_4O)_xH$, where x is in the range of from 1 to 3.

Ampholytic Surfactant

Ampholytic surfactants can be incorporated into the detergent compositions herein. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants.

Amphoteric Surfactant

Suitable amphoteric surfactants for use herein include the alkyl amphocarboxylic acids of the formula:

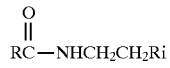

wherein R is a $C_8$–$C_{18}$ alkyl group, and $R_i$ is of the general formula:

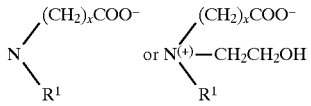

wherein $R^1$ is a $(CH_2)_xCOOM$ or $CH_2CH_2OH$, and x is 1 or 2 and M is preferably chosen from alkali metal, alkaline earth metal, ammonium, mono-, di-, and triethanolammonium, most preferably from sodium, potassium, ammonium and mixtures thereof with magnesium ions. The preferred R alkyl chain length is a $C_{10}$ to $C_{14}$ alkyl group. A preferred amphocarboxylic acid is produced from fatty imidazolines wherein the dicarboxylic acid functionality of the amphodicarboxylic acid is diacetic acid and/or dipropionic acid. A suitable example of an alkyl aphodicarboxylic acid for use herein in the amphoteric surfactant Miranol™ C2M Conc. manufactured by Miranol, Inc., Dayton, N.J.

Amine Oxide Surfactant

Amine oxides useful, as amphoteric surfactants, in the present invention include those compounds having the formula:

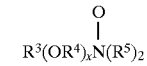

wherein $R^3$ is selected from an alkyl, hydroxyalkyl, acylamidopropoyl and alkyl phenyl group, or mixtures thereof, containing from 8 to 26 carbon atoms, preferably 8 to 16 carbon atoms; $R^4$ is an alkylene or hydroxyalkylene group containing from 2 to 3 carbon atoms, preferably 2 carbon atoms, or mixtures thereof; x is from 0 to 3, preferably 0; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure. These amine oxide surfactants in particular include $C_{10}$–$C_{18}$ alkyl dimethyl amine oxides and $C_8$–$C_{12}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide and dimethyl-2-hydroxyoctadecylamine oxide. Preferred are $C_{10}$–$C_{18}$ alkyl dimethylamine oxide, and $C_{10-18}$ acylamido alkyl dimethylamine oxide.

Zwitterionic Surfactant

Zwitterionic surfactants can also be incorporated into the detergent compositions herein. See U.S. Pat. No. 3,929,678 to Laughlin et al., issued Dec. 30, 1975 at column 19, line 38 through column 22, line 48 for examples of zwitterionic surfactants.

Betaine Surfactant

The betaines useful, as zwitterionic surfactants, in the present invention are those compounds having the formula $R(R')_2N^+R^2COO^-$ wherein R is a $C_6$–$C_{18}$ hydrocarbyl group, preferably a $C_{10}$–$C_{16}$ alkyl group or $C_{10-16}$ acylamido alkyl group, each $R^1$ is typically $C_1$–$C_3$ alkyl, preferably methyl, m and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethylbetaine; [$C_{12-16}$ acylmethylamidodimethylbetaine. Preferred betaines are $C_{12-18}$ dimethyl-ammonio hexanoate and the $C_{10-18}$ acylamidopropane (or ethane) dimethyl (or diethyl) betaines.

The complex betaines suitable for use herein have the formula:

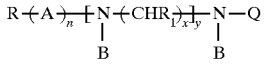

(I)

wherein R is a hydrocarbon group having from 7 to 22 carbon atoms, A is the group (C(O)), n is 0 or 1, $R_1$ is hydrogen or a lower alkyl group, x is 2 or 3, y is an integer of 0 to 4, Q is the group $-R_2COOM$ wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

Sultaines

The sultaines useful in the present invention are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group.

Organic Solvent

The compositions of the invention will most preferably contain an organic solvent system present at levels of from 1% to 30% by weight, preferably from 3% to 25% by weight, more preferably form 5% to 20% by weight of the composition.

Suitable organic solvent for use herein has the general formula $CH_3$ $RO(CH_2CHO)_nH$ wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1-n-butoxypropane-2-ol (n=1); and 1(2-n-butoxy-1-methylethoxy)propane-2-ol (n=2), and mixtures thereof.

Other solvents useful herein include the water soluble CARBITOL solvents or water-soluble CELLOSOLVE solvents. Water-soluble CARBITOL solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE solvents are compounds of the 2-alkoxyethoxy ethanol class, with 2-butoxyethoxyethanol being preferred.

Other suitable solvents are benzyl alcohol, and diols such as 2-ethyl-1,3-hexanediol and 2,2,4-trimethl-1,3-pentanediol.

The low molecular weight, water-soluble, liquid polyethylene glycols are also suitable solvents for use herein.

The alkane mono and diols, especially the $C_1$–$C_6$ alkane mono and diols are suitable for use herein. The C1–C4 dihydric alcohols, including propylene glycol, are preferred. It is preferred that monohydric alcohols, especially ethanol, are present at less than 6% by weight of the composition.

Suds-Enhancing Agents

The compositions of the present invention may comprise from 0.1% to 20%, preferably from 2% to 20% by weight of a suds enhancing agent selected from the group consisting of amine oxides, betaines, sultaines, complex betaines, and certain nonionics.

Preferred amides are $C_8$–$C_{20}$ alkyl mono- or di-$C_2$–$C_3$ alkanolamides, especially monoethanolamides, diethanolamides, and isopropanolamides.

Preferred suds enhancing agents are $C_{10-18}$ acyl amide alkyl dimethyl amine oxides, betaines, condensation products of aliphatic alcohols with ethylene oxides, and alkylpolysaccharides, and mixtures thereof.

Hydrotropes

A hydrotrope is typically added to the compositions of the present invention, and may be present at levels of from 0.5% to 10%, preferably from 1% to 5%, by weight.

Useful hydrotropes include sodium, potassium, and ammonium xylene sulfonates, sodium, potassium, and ammonium toluene sulfonate, sodium potassium and ammonium cumene sulfonate, and mixtures thereof.

Other compounds useful as hydrotropes herein include polycarboxylates. Some polycarboxylates have calcium chelating properties as well as hydrotropic properties. Particularly useful hydrotropes are alkylpolyethoxy polycarboxylate surfactants of the type as previously described herein.

An example of a commercially available alkylpolyethoxy polycarboxylate which can be employed herein is POLY-TERGENT C, Olin Corporation, Cheshire, Conn.

Another compound useful as a hydrotrope is alkyl amphodicarboxylic acid of the generic formula:

$(CH_2)_xCOO^-$ $RCNHCH_2CH_2N<$ $(CH_2)_xCOOM$ wherein R is a $C_8$ to $C_{18}$ alkyl group, x is from 1 to 2, M is preferably chosen from alkali metal, alkaline earth metal, ammonium, mono-, di-, and tri-ethanolammonium, most preferably from sodium, potassium, ammonium, and mixtures thereof with magnesium ions. The preferred alkyl chain length (R) is a $C_{10}$ to $C_{14}$ alkyl group and the dicarboxylic acid functionally is diacetic acid and/or dipropionic acid.

A suitable example of an alkyl amphodicarboxylic acid is the amphoteric surfactant Miranol R 2CM Conc.manufactured by Miranol, Inc., Dayton, N.J.

Lime Soap Dispersants

The compositions of the present invention are particularly useful when formulated to contain a lime soap dispersant compound which acts to disperse any insoluble lime soap salts which may be formed between the fatty acids produced by the lipolytic hydrolysis of fats/oils and calcium ions in the wash soluble, thereby preventing the deposition of these salts as spots or films on the articles in the wash, or as an unseemly ring around the rim of the sink. Certain lime soap dispersant compounds may also provide improved product stability particularly where the product is formulated as a liquid product containing calcium ions.

A lime soap dispersant compound herein is defined as a compound, which has a lime soap dispersing power (LSDP), as of no more than 8, preferably no more than 7, most preferably no more than 6.

The LSDP is the % weight ration of dispersing agent to sodium oleate required to disperse the lime soap deposits formed by 0.025 g of sodium oleate in 30 ml of water of 333 ppm CaCO3 (Ca:Mg=3:2) equivalent hardness. The lime soap dispersant compound is typically present at a level of from 0.1% to 40% by weight, more preferably 1% to 20% by weight, most preferably from 2% to 10% by weight of the compositions.

Calcium

From 0% to 3%, preferably from 0.5% to 3%, more preferably from 0.15% to 2% of calcium ions may be included in the detergent compositions herein. It has been found for compositions containing polyhydroxy fatty acid amide that the presence of calcium greatly improves the cleaning of greasy soils. This is especially true when the compositions are used in softened water, which contains few divalent ions.

The calcium ions can, for example, be added as a chloride, hydroxide, oxide, formate or acetate, or nitrate salt. If the anionic surfactants are in the acid form, the calcium can be added as a calcium oxide or calcium hydroxide slurry in water to neutralise the acid.

The calcium ions may be present in the compositions as salts. The amount of calcium ions present in compositions of the invention may be dependent upon the amount of total anionic surfactant present herein. The molar ratio of calcium ions to total anionic surfactant is preferably from 1:0.1 to 1:25, more preferably from 1:2 to 1:10, for compositions of the invention.

Calcium Stabilizing Agent

Malic, maleic or acetic acid, or their salts, or certain lime soap dispersant compounds may be added to a composition formulated to contain calcium to provide good product stability, and in particular to prevent the precipitation of insoluble calcium salts. Where calcium is present, malic, maleic or acetic acid, or their salts can be added at levels of from 0.05% to 10% of the composition and a molar ratio with calcium of from 0.01:1 to 1:10.

Magnesium

From 0.01% to 3%, most preferably from 0.15% to 0.9%, by weight, of magnesium ions are preferably added to the liquid detergent compositions of the invention for improved product stability, as well as improved sudsing.

If the anionic surfactants are in the acid form, then the magnesium can be added by neutralization of the acid with a magnesium oxide or magnesium hydroxide slurry in water. Calcium can be treated similarly. This technique minimises the addition of chloride ions, which reduces corrosive properties. The neutralized surfactant salts and the hydrotrope are then added to the final mixing tank and any optional ingredients are added before adjusting the pH.

Form of the Compositions

The compositions are fluid in nature, being for example liquids, gels, creams, foams or mousses.

Liquid Compositions

In one preferred embodiment, the detergent compositions of the present invention are liquid detergent compositions. These preferred liquid detergent compositions typically comprise from 94% to 35% by weight, preferably from 90% to 40% by weight, most preferably from 80% to 50% by weight of a liquid carrier, e.g., water, preferably a mixture of water and organic solvent.

Gel Compositions

The detergent compositions of the present invention may also be in the form of gels. Such compositions are typically formulated in polyakenyl polyether and having a molecular weight of from about 750,000 to about 4,000,000.

Highly preferred examples of these polycarboxylate polymer thickeners are the Carbopol 600 series resins available from B.F. Goodrich. Especially preferred are Carbopol 616 and 617. It is believed that these resins are more highly cross-linked than the 900 series resins and have molecular weights between about 1,000,000 and 4,000,000. Mixtures of polycarboxylate polymers as herein described may also be used in the present invention. Particularly preferred is a mixture of Carbopol 616 and 617 series resins.

The polycarboxylate polymer thickener is utilized preferably with essentially no clay thickening agent. In fact, it has been found that if the polycarboxylate polymers of the present invention are utilized with clay in the composition of the present invention, a less desirable product, in terms of phase instability, results. In other words, the polycarboxylate polymer is preferably used instead of clay as a thickening/stabilizing agent in the present compositions.

If the polycarboxylate polymer is used as a thickening agent in the compositions of the present invention, it is typically present at a level of from about 0.1% to about 10%, preferably from about 0.2% to about 2% by weight.

The thickening agents are preferably used to provide a yield value of from about 50 to about 350 and most preferably from about 75 to about 250. The yield value is an indication of the shear stress at which the gel strength is exceeded and flow is initiated. It is measured herein with a Brookfield RVT model viscometer with a T-bar B spindle at 25° utilizing a Helipath.

Other desirable ingredients typically used in the compositions herein include dyes, perfumes and opacifiers.

Opacifiers such as Lytron (Morton Thiokol, Inc.), a modified polystyrene latex, or ethylene glycol distearate can be added, preferably as a last step. Lytron can be added directly as a dispersion with mixing. Ethylene glycol distearate can be added in a molten state with rapid mixing to form pearlescent crystals. Opacifiers useful herein, particularly for light duty liquids, are typically present at levels from about 0.2% to about 10%, preferably from about 0.5% to about 6% by weight.

Manual Diswashing Method

According to the manual dishwashing method aspect of this invention, soiled dishes are contacted with an effective amount, typically from about 0.5 g to about 20 g (per 25 dishes being treated), preferably from about 3 g to about 10 g, of the composition of the present invention. The actual amount of detergent composition used will be based on the judgement of user, and will depend upon factors such as the particular product formulation of the composition, the concentration of the composition, the number of soiled dishes to be cleaned and the degree of soiling of the dishes.

Concentrated Solution Washing Methods

In one preferred method aspect of the invention a concentrated solution of the detergent composition is applied to the surface of the dishes to be washed. By concentrated solution of the composition it is meant no less than a 20% by weight, preferably no less than 50% by weight product dilution, and most preferably the composition is applied in undiluted form.

Application of the detergent to the surface of the dishes can be enabled by use of an applicator such as a sponge, cloth or brush to which detergent has previously been applied, or in an alternative and preferred process the product is sprayed on to the surface of the dishes. The detergent will typically be distributed on the surface of the dishes in such a way that heavily soiled areas are more heavily dosed than those where only light soiling is present. The dishes may have been pre-rinsed or pre-soaked in water prior to application of the detergent, although this is not necessary.

The concentrated solution of the detergent composition is allowed to remain on the surface of dishes for a period of time. The precise length of this time period will depend on a number of factors including degree of soiling of the dishes, amount of detergent applied, the extent of any pre-rinsing or pre-soaking in water, and the nature of any subsequent rinsing or washing steps.

Subsequently, the dishes are subjected to a manual or machine washing or rinsing method, involving either further washing steps and use of detergent product, and/or to a manual or machine rinsing method. Preferably the dishes are subjected solely to a manual or machine rinsing method.

Preferred methods in which a concentrated solution of the detergent composition is applied to the surface of the dishes to be washed, termed herein the "direct application method" and "detergent presoak method" are hereinafter more fully described.

Direct Application Method

The direct application method will typically comprise as a first step wetting the soiled dishes, by eg: immersing in a water bath without any liquid dishwashing detergent, or holding under a running tap. A device for absorbing liquid dishwashing detergent, such as a sponge, is then placed directly into a separate quantity of concentrated liquid or gel detergent composition for a period of time typically ranging from about 1 to about 5 seconds. The absorbing device, and consequently the undiluted detergent composition, is then contacted individually to the surface of each of the soiled dishes. The absorbing device is typically contacted with each dish surface for a period of time range from 1 to 10 seconds, although the actual time of application will be dependent upon factors such as the degree of soiling of the dish. The contacting of the absorbing device to the dish surface is preferably accompanied by concurrent scrubbing. Subsequently, the dishes are rinsed manually by immersion in a water bath or by passing under a stream of running water, with typically further manual agitation of the dish surface.

Detergent Pre-soak Method

In the detergent pre-soak method herein, the concentrated solution of detergent is applied to the surface of the dishes by any of the aforementioned means, and is allowed to remain on the dishes for an extended period of time of from 30 seconds to 24 hours, more typically from 5 minutes to 1 hour, preferably from 10 minutes to 30 minutes. The dishes are subsequently subjected to a manual or machine dishwashing or rinsing method, preferably a rinsing method. Where the subsequent dishwashing or rinsing method utilizes a dishwashing machine it is preferred that the composition used in the detergent pre-soak method contains suds suppressor at a level of from 0.01% to 15% by weight. The suds suppressor may be any of these commonly known in the art including silicone suds suppressor.

Dilute Solution Washing Methods

In another preferred method aspect of the invention large volume of a dilute solution of the detergent composition is employed. The dishes are preferably allowed to soak for a period of time, typically from 5 seconds to 30 minutes in the dilute solution.

Dilute solution washing methods include the "dilute solution in sink" and "dilute solution in bowl" methods hereinafter described.

Dilute Solution in Sink Method

In the typical dilute solution in sink method from about 3 ml. to 15 ml., preferably from 5 ml. to 10 ml. of a liquid detergent composition is combined with from 1,000 ml. to 10,000 ml., more typically from 3,000 ml. to 5,000 ml. of water in a sink having a volumetric capacity in the range of from 5,000 ml. to 20,000 ml., more typically from 10,000 ml. to 15,000 ml. The detergent composition has a surfactant concentration of from about 10% to about 60% by weight, preferably from about 45% to about 50% by weight. The soiled dishes are immersed in the sink containing the detergent composition and water, where they are cleaned by the soaking action of the solution and by manual agitation of the soiled surface of the dish by contacting with a cloth, sponge or similar article. Preferably the dishes are allowed to soak in the dilute detergent solution in the sink for a period of time of from 5 seconds to 30 minutes, preferably from 30 seconds to 10 minutes, before manual agitation. The cloth, sponge or similar article may be immersed in the detergent composition and water mixture prior to being contacted with the dish surface and is typically contacted with the dish surface for a period of time ranging from about 1 to about 10 seconds, although the actual time will vary with each application and user. The contacting of the cloth, sponge or similar article to the dish surface is preferably accompanied by a concurrent scrubbing of the dish surface.

Dilute Solution in Bowl Method

In a typical solution in bowl method from 1 ml. to 50 ml., prefrably from 2 ml. to 10 ml. of a detergent composition is combined with from 50 ml. to 2,000 ml., more typically from 100 ml. to 1,000 ml. of water in a bowl having a volumetric capacity in the range of from 500 ml. to 5,000 ml., more typically from 500 ml. to 2,000 ml. The detergent composition has a surfactant concentration of from about 10% to about 60% by weight, preferably from about 15% to about 50% by weight. The soiled dishes are immersed in the bowl containing the detergent composition and water, where they are cleaned by the soaking action of the solution, and by manual agitation of the soiled surface of the dish by contacting with a cloth, sponge or similar article. Preferably the dishes are allowed to soak in the dilute detergent solution in the sink for a period of time of from 5 seconds to 30 minutes, preferably from 30 seconds to 10 minutes, before manual agitation. The cloth, sponge or similar article may be immersed in the detergent composition and water mixture prior to being contacted with the dish surface and is typically contacted with the dish surface for a period of time ranging from about 1 to about 10 seconds, although the actual time will vary with each application and user. The contacting of the cloth, sponge or similar article to the dish surface is preferably accompanied by a concurrent scrubbing of the dish surface.

EXAMPLES

The following compositions in accord with the invention were prepared.

| | % by weight | | | | | |
|---|---|---|---|---|---|---|
| | I | II | III | IV | V | VI |
| C12/13 alkyl ethoxy (ave. 0.8) sulphate | 10.0 | 10.0 | 9.0 | 5.0 | 10.0 | 10.0 |
| C12/13 alky1 ethoxy (ave. 3) sulphate | 7.0 | 7.0 | 8.0 | 15.0 | 7.0 | 10.0 |
| C12/14 alkyl amine oxide | 2.0 | 1.0 | — | 1.0 | 2.0 | 5.0 |
| C12/14 alkyl di methyl betaine | — | 1.0 | 1.5 | 2.0 | — | — |
| C12/14 Ampholak (TM) | — | — | 1.5 | — | — | — |
| C12 alkyl N-methyl glucamide | 12.0 | 12.0 | 9.0 | 11.0 | 12.0 | 7.0 |
| C10 Alkyl Ethoxylate (ave. 8) | 5.0 | 5.0 | 5.0 | 4.6 | 5.0 | 4.0 |
| $Mg^{++}$ ion | — | 0.6 | — | 0.3 | 0.6 | 0.6 |
| $Ca^{++}$ ion | — | — | 0.3 | 0.15 | 0.1 | 0.1 |
| Maleic acid | — | — | 0.2 | 0.3 | — | — |
| Miranol (TM) | — | — | 2.0 | — | — | — |
| Polytergent (TM) | — | — | — | 2.0 | — | — |
| Lipase | 0.005 | 0.01 | 0.02 | 0.03 | 0.04 | 0.03 |
| Amylase | 0.01 | 0.02 | 0.01 | 0.02 | 0.03 | 0.02 |

The lipase is a lipolytic enzyme sold under the tradename, lipolase, by Novo Industries A/S. Levels of active enzyme in the compositions are given. Commercial samples typically have an activity of about 2%.

The amylase is amylolytic enzyme sold under the tradename, termamyl, by Novo Industries A/S. Levels of active enzyme in the compositions are given. Commercial samples typically have an activity of about 1% to 4%.

The compositions were prepared by mixing all of the surfactants with the exception of the glucamide. The magnesium and calcium salts were then pre-dissolved into solution together with the maleic acid and added to the surfactant mixture with the remaining components. Finally the pH was trimmed to 7.3 using hydrochloric acid and the viscosity checked.

What is claimed is:

1. A manual dishwashing composition comprising the following:

(A) a surfactant;

(B) an ion selected from the group consisting of calcium ion in an amount of 0.15% to 2% of the composition, magnesium ion in an amount of 0.15% to 0.9% of the composition and mixtures thereof;

(C) amylase enzymes;

(D) lipase enzymes; and (E) 0.2% to 2% of a polycarboxylic polymer thickener component.

2. A composition according to claim 1 wherein said composition is the form of a liquid or gel.

3. A composition according to claim 1 wherein said composition contains no builder salts.

4. A composition according to claim 1 wherein said composition contains no bleaching components.

5. A composition according to claim 1 comprising from 5% to 80%, by weight, of surfactant selected from the group consisting of nonionic, anionic, cationic, zwitterionic, ampholytic and amphoteric surfactants and mixtures thereof.

6. A composition according to claim 1 wherein the pH of 1% by weight solution of said composition is from about 5.5 to about 8.5.

7. A composition according to claim 1 comprising from 0.05% to 3%, by weight, calcium ions.

8. A composition according to claim 1 comprising from 0.1% to 20%, by weight, of a suds enhancing agent.

9. A composition according to claim 1 comprising nonionic surfactant and anionic surfactant such that the weight ratio of nonionic surfactant to anionic surfactant is greater than 1:1.

10. A manual dishwashing composition comprising the following:

(A) a surfactant;

(B) an ion selected from the group consisting of calcium ion in an amount of 0.15% to 2% by weight of the composition, magnesium ion in an amount of 0.15% to 0.9% by weight of the composition, and mixtures thereof;

(C) amylase enzymes;

(D) lipase enzymes; and (E) 0.05% to 10% by weight of the composition of a calcium stabilizing agent selected from the group consisting of malic acid, malic acid salts, maleic acid, maleic acid salts, and mixtures thereof.

11. A composition according to claim 10, wherein the surfactant comprises a polyhydroxy fatty acid amide surfactant having the formula:

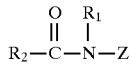

wherein $R_1$ is H, $C_1$–$C_4$ hydrocarbyl, 2-hydroxyl ethyl or 2-hydroxy propyl;

$R_2$ is a $C_5$–$C_{31}$ hydrocarbyl; and

Z is a polyhydroxyhydrocarbyl having a linear hydrocarbyl chain with at least 3 hydroxyls directly connected to the chain, or an alkoxylated derivative of said polyhydroxyhydrocarbyl wherein at least one of the hydroxyls is alkoxylated.

12. A composition according to claim 10, wherein said surfactant is an anionic surfactant, and wherein the molar ratio of calcium ions to total anionic surfactant is from 1:0.1 to 1:25.

13. A composition according to claim 10 wherein said ion is magnesium ions 0.01% to 3%, by weight, magnesium ions.

14. A composition according to claim 10 wherein the pH of 1%, by weight, solution of said composition is from 3 to 6.

15. A manual dishwashing composition according to claim 10 wherein the composition comprises by weight from 0.001% to 2% lipase enzyme and from 0.005% to 2% amylase enzyme.

16. A manual dishwashing detergent composition according to claim 10 wherein said surfactant comprises from 30% to 70% by weight anionic surfactant and 30% to 70% nonionic surfactant.

* * * * *